US008526835B2

(12) United States Patent
Lee et al.

(10) Patent No.: US 8,526,835 B2
(45) Date of Patent: Sep. 3, 2013

(54) CLOSED LOOP CONTROLS FOR TRANSFER CONTROL IN FIRST TRANSFER FOR OPTIMIZED IMAGE CONTENT

(75) Inventors: Joanne Lai Zen Lee, Rochester, NY (US); John T. Buzzelli, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 51 days.

(21) Appl. No.: 13/089,855

(22) Filed: Apr. 19, 2011

(65) Prior Publication Data

US 2012/0269526 A1 Oct. 25, 2012

(51) Int. Cl.
*G03G 15/00* (2006.01)
*G03G 15/01* (2006.01)
*G03G 15/16* (2006.01)

(52) U.S. Cl.
USPC ..... 399/49; 399/39; 399/40; 399/66

(58) Field of Classification Search
USPC ..... 399/49, 66
See application file for complete search history.

(56) References Cited

U.S. PATENT DOCUMENTS

| | | | | |
|---|---|---|---|---|
| 4,359,753 | A | 11/1982 | Marshall | |
| 5,274,424 | A * | 12/1993 | Hattori et al. | 399/49 |
| 5,887,223 | A * | 3/1999 | Sakai et al. | 399/60 |
| 5,937,229 | A * | 8/1999 | Walgrove et al. | 399/66 |
| 6,181,888 | B1 * | 1/2001 | Scheuer et al. | 399/49 |
| 6,483,997 | B1 * | 11/2002 | Nakazato | 399/46 |
| 6,681,094 | B2 | 1/2004 | Horrall et al. | |
| 7,190,913 | B2 | 3/2007 | DiRubio et al. | |
| 7,212,757 | B2 * | 5/2007 | Kudou et al. | 399/66 |
| 7,292,798 | B2 * | 11/2007 | Furukawa et al. | 399/49 |
| 7,756,429 | B2 * | 7/2010 | Inoue | 399/49 |
| 2004/0141765 | A1 * | 7/2004 | Shimura et al. | 399/49 |
| 2004/0184830 | A1 * | 9/2004 | Miyamoto et al. | 399/66 |
| 2005/0196190 | A1 * | 9/2005 | Yamada | 399/66 |
| 2005/0238374 | A1 * | 10/2005 | Yoshida | 399/49 |
| 2005/0244179 | A1 * | 11/2005 | Rakov et al. | 399/66 |
| 2006/0222389 | A1 * | 10/2006 | Kin et al. | 399/49 |
| 2006/0251449 | A1 * | 11/2006 | Takahashi et al. | 399/265 |
| 2007/0002291 | A1 * | 1/2007 | Yamada | 355/18 |
| 2007/0242968 | A1 * | 10/2007 | Chiba | 399/66 |
| 2007/0297824 | A1 * | 12/2007 | Yamada | 399/66 |
| 2008/0003002 | A1 * | 1/2008 | Julien | 399/49 |
| 2008/0152369 | A1 | 6/2008 | DiRubio et al. | |
| 2008/0152371 | A1 | 6/2008 | Burry et al. | |
| 2010/0080602 | A1 * | 4/2010 | Taguma | 399/71 |
| 2010/0266302 | A1 * | 10/2010 | Suzuki et al. | 399/49 |
| 2010/0329702 | A1 | 12/2010 | Dirubio et al. | |
| 2011/0102818 | A1 * | 5/2011 | Lee | 358/1.9 |
| 2011/0222870 | A1 * | 9/2011 | Miyagi | 399/15 |

FOREIGN PATENT DOCUMENTS

EP 0 465 218 B1 10/1995

OTHER PUBLICATIONS

L. B. Schein, "Recent advances in our understanding of toner charging", Journal of Electrostatics 46, 1999, pp. 29-36.

* cited by examiner

*Primary Examiner* — Walter L Lindsay, Jr.
*Assistant Examiner* — David Bolduc
(74) *Attorney, Agent, or Firm* — Fay Sharpe LLP

(57) ABSTRACT

An electrostatic transfer control method that avoids undesired retransfer effects. A printing device develops and transfers several control patches. The patches are transferred at different electrostatic set points and a control strategy is utilized involving one or more density sensors to measure the transferred toner patches whereby the obtained density information can be used to compute the optimal value of electrostatic transfer bias. Print operators can adjust the bias value based on preferences for predetermined standards.

15 Claims, 5 Drawing Sheets

CLOSED LOOP CONTROLS FOR TRANSFER CONTROL IN FIRST TRANSFER FOR OPTIMIZED IMAGE CONTENT

BACKGROUND

The present disclosure relates to multi-color document processing systems such as printers, copiers, multi-function devices, etc., and to control techniques for operating the same. The disclosures of U.S. Patent Application Publication Nos. 2008/0152369 to DiRubio et al., 2008/0152371 to Burry et al., and 2010/0329702 to Dirubio et al., and the disclosure of U.S. patent application Ser. No. 12/612,121, filed Nov. 4, 2009 and entitled "Dynamic Field Transfer Control in First Transfer" to Lee are hereby incorporated by reference in their entireties. Multi-color toner-based xerographic printing systems typically employ two or more xerographic marking devices to individually transfer toner of a given color to an intermediate transfer structure, such as a drum or belt (referred to as first transfer operations), with the toner being subsequently transferred (in a second transfer operation) from the intermediate medium to a sheet or other final print medium, after which the twice transferred toner is fused to the final print.

Retransfer occurs when toner on the intermediate belt from previous, upstream marking devices is wholly or partially removed (scavenged) due to high transfer fields within the current transfer nip. High fields in the transfer nips in the downstream marking devices can adversely modify the charge state of the toner on the intermediate transfer belt (ITB) through air breakdown mechanisms, further exacerbating retransfer. When this happens, the desired amount of one or more toner colors is not transferred to the final printed sheet, and the retransfer problem worsens as the number of colors increases. Retransfer at a given marking device may be reduced by lowering the transfer field strength at that device, but this may lead to incomplete transfer during image building at that device. In other words, the transfer nip may be transferring toner to the ITB at one region in the cross-process direction (image building), which requires high fields, while simultaneously scavenging toner from the ITB in another region (retransfer). In addition, the quality requirements of multi-color document processing systems are constantly increasing, with customers demanding improved imaging capabilities without adverse effects of retransfer and incomplete transfer.

Current xerographic transfer controls are optimized against many noise factors such as relative humidity and age of the components. However, the controls may not be optimized for image content, which is ultimately important to end users and customers. While transfer is quite robust for image building, retransfer is still a problem since this defect reduces image quality and increases toner-to-waste (increases run cost). Retransfer is also magnified when products have more than four colors.

One proposed solution is U.S. Patent Application Publication No. 2010/0329702 to DiRubio et al., published Dec. 30, 2010, entitled "Multi-Color Printing System and Method for Reducing the Transfer Field Through Closed Loop Controls", which minimizes retransfer by detecting the amount of toner transferred to the intermediate transfer belt and employing closed loop controls. However, even this solution leaves residual toner and thus is not a complete solution to the retransfer problem.

Another proposed solution is U.S. patent application Ser. No. 12/612,121, filed Nov. 4, 2009, to Lee, entitled "Dynamic Field Transfer Control In First Transfer", which presents a multi-color document processing system and method to control color retransfer by allowing operators to override nominal electrostatic transfer control settings and set more optimum conditions for a variety of specific and particular print jobs. This, thus, disables marking devices which are not needed for a particular print job and operates devices required for printing at a reduced transfer field levels for the first transfer. This solution reduces transfer, but at the penalty of reducing the speed at which the print device operates. In addition, this approach may cause a reduction in the amount of toner that transfers from the photoreceptor (P/R) to the ITB. A phenomenon called "incomplete transfer."

BRIEF DESCRIPTION

The present embodiments disclose an electrostatic transfer control method that optimizes transfer efficiency, color gamut, and image quality. More particularly compensating for undesired retransfer effects. A printing device develops and transfers several control patches. The patches are transferred at different electrostatic set points and a control strategy is utilized involving one or more density sensors to measure the transferred toner patches whereby the obtained density information can be used to compute the optimal value of electrostatic transfer bias. The subject control strategy can allow print operators to adjust the bias value based on preferences for predetermined standards. The embodiments provide a more robust first transfer system which can also be applied to more than four color IBT marking engines.

A first embodiment comprises a method of operating the document processing system having a plurality of marking devices of different colors individually operable to transfer marking material in a first transfer operation onto an intermediate transfer structure. The method comprises (a) importing a plurality of control patches of preselected colors wherein the colors are repetitively imported at a plurality of electrostatic transfer bias set points, (b) sensing a density of the control patches, (c) detecting a highest density color of the repetitively imported patches, and (d) determining an optimal first transfer bias based on the detected highest density, whereby subsequent operation of the document printing system selectively employs the optimal first transfer bias.

An additional embodiment comprises a system for controlling print transfer. The system comprises a printer including a plurality of one color print modules, each module comprising a print head and an adjoining nip, each module associated with one individual color. At least one sensor is associated with each individual color. An algorithm calculates the optimal transfer bias based on data gathered by the sensors. A graphical user interface facilitates user data entry and approval acknowledgment data. The processor further receives the data gathered by the sensor, receives user entered settings data and executes the algorithm using the received data. The printer prints at least one test patch printed out in response to a calculated optimal transfer bias.

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter, in which.

DETAILED DESCRIPTION

Figure 1:
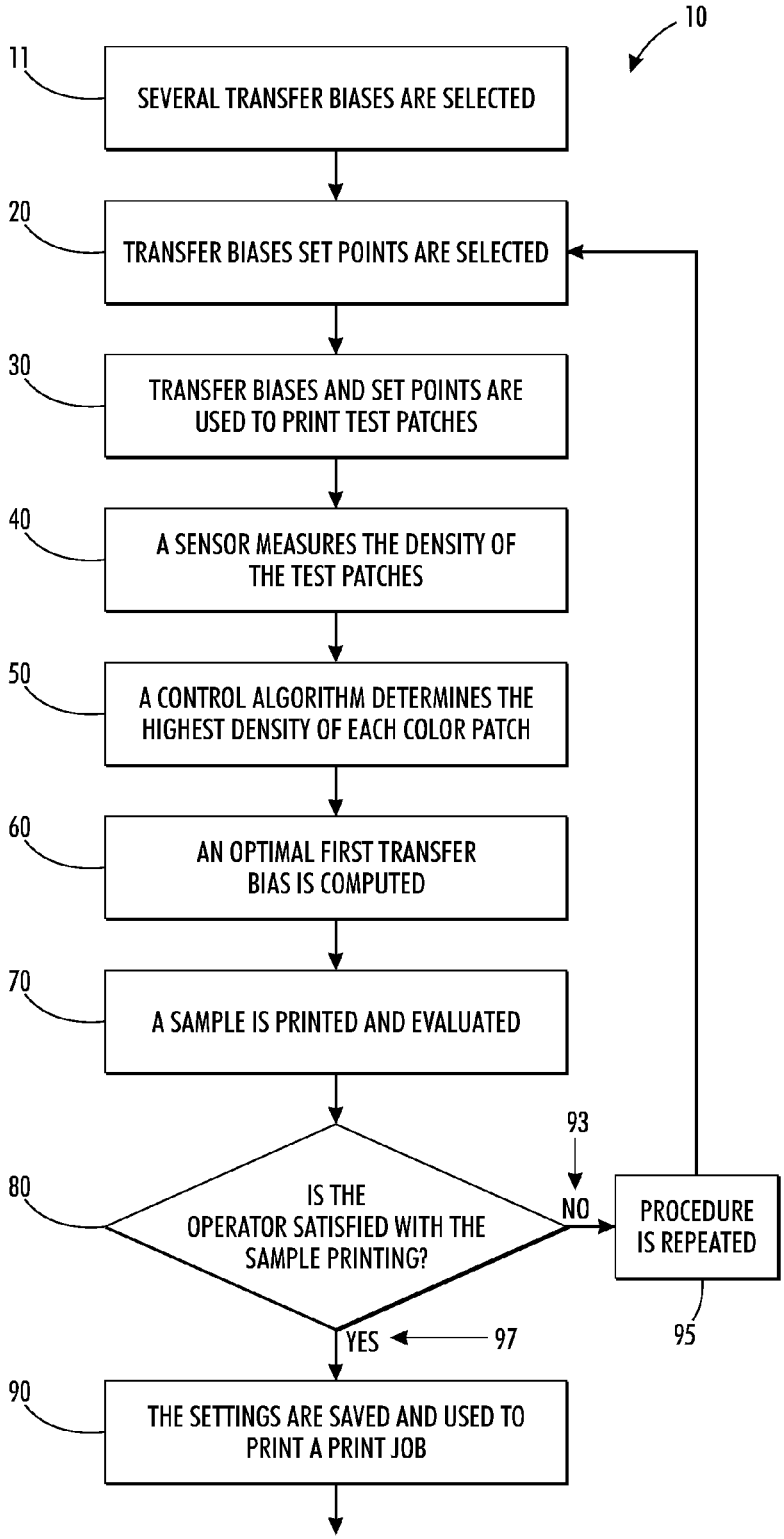
FIG. 1 is a flow diagram illustrating an exemplary method for operating a document processing system in accordance with one or more aspects of the disclosure.

Several embodiments or implementations of the different aspects of the present disclosure are hereinafter described in conjunction with the drawings, wherein like reference numerals are used to refer to like elements throughout, and wherein the various features, structures, and graphical renderings are not necessarily drawn to scale. Certain embodiments are illustrated and described below in the context of exemplary multi-color document processing systems that employ multiple xerographic marking devices or stations in which toner marking material is first transferred to an intermediate structure and ultimately transferred to a final print medium to create images thereon in accordance with a print job. However, the techniques and systems of the present disclosure may be implemented in other forms of document processing or printing systems that employ any form of marking materials and techniques in which marking device fields are used for material transfer, such as ink-based printers, etc., wherein any such implementations and variations thereof are contemplated as falling within the scope of the present disclosure.

An exemplary method 100 is illustrated in FIG. 1 and FIGS. 2-5 illustrate various aspects of an exemplary tandem multi-colored document processing system 200 having a plurality of marking devices which may be operated according to the exemplary method 100, wherein marking devices as used herein includes without limitation marking engines, marking stations, etc. The method 100 involves operating the marking devices in a normal mode to selectively transfer marking material onto an intermediate transfer medium in accordance with a print job with transfer field elements of the devices being operated at a first set of field levels (i.e. transfer biases), and in a second or enhanced mode wherein the transfer biases are adjusted to produce highest density colors, or are further adjusted in accordance with an operator selectively applied preference.

While the exemplary method 100 is illustrated and described in the form of a series of acts or events, the various methods of the disclosure are not limited by the illustrated ordering of such acts or events except as specifically noted, and some acts or events may occur in different order and/or concurrently with other acts or events apart from those illustrated and described herein, and not all illustrated steps may be required to implement a process or method in accordance with the present disclosure. The illustrated method 100, moreover, may be implemented in hardware, processor-executed software, or combinations thereof, in one or more control elements operatively associated with a document processing system in order to provide the selective functionality set forth herein for a given print job, such as in a printing system as shown in FIGS. 2-5, wherein the disclosure is not limited to the specific applications and implementations illustrated and described herein.

Referring to FIGS. 2-5, the document processing system 200 comprises a multi-engine marking assembly including a system controller 122 and marking devices 102 which may be operated in accordance with the method 100 in a normal printing mode. The system 200 includes a plurality of xerographic marking devices 102 individually operable by the controller 122 to transfer toner marking material onto an intermediate transfer structure 103, in this case, a shared intermediate transfer belt (ITB) 103 traveling in a counter clockwise direction in the figures past the xerographic marking devices 102, also referred to as marking engines, marking elements, marking stations, etc. In other embodiments, a cylindrical drum may be employed as an intermediate transfer structure with marking devices 102 positioned around the periphery of the drum to selectively transfer marking material thereto in a first transfer operation.

Figure 5:
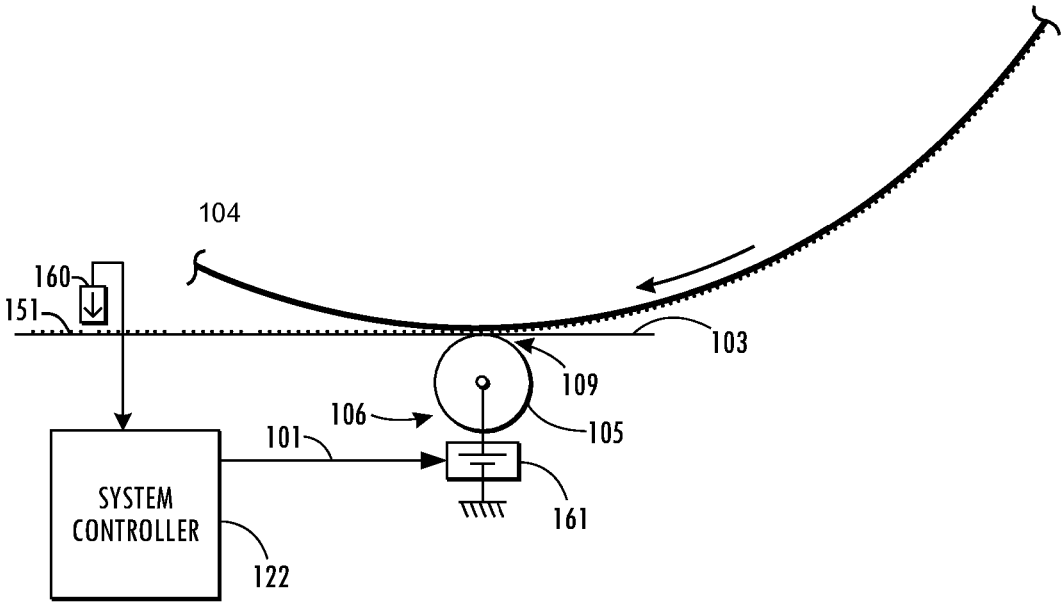
FIG. 5 shows a closed schematic view of a print nip and system controlling processor.

As best shown in FIG. 5, each exemplary xerographic marking device 102 includes a photoreceptor drum 104, a pre-transfer charging subsystem 106, by which the toner image of a given color (e.g., cyan, magenta, yellow, black, or one or more spot toners or gamut extension colors such as orange or violet) is developed on the photoreceptor 104 and transferred electrostatically to the intermediate transfer structure 103 using a biased transfer roller (BTR) 105 located on the inside of the intermediate transfer belt 103. The BTR 105 operates at a transfer field value provided by a field strength control device according to a first transfer field level signal or value provided by the controller 122 for setting the transfer field used by the device 102 to transfer marking material, in this case, toner, to the structure 103. In operation of the device 102, marking material (e.g., toner 114 for the first (Yellow) device 112 detailed in FIG. 2) is supplied to the drum 104. In a first transfer operation, a surface of the intermediate medium 103 is adjacent to and/or in contact with the drum 104 and the toner 114 is transferred to the medium 103 with the assistance of the biased transfer roller 105, where the BTR 105 induces charge into the BTR and the intermediate structure surface 103 to attract oppositely charged toner 114 from the drum 104 to the belt surface 103 as it passes through a nip created between the drum 104 and the charged transfer roller 105, where the transfer charging is controlled by a bias control 101 operated by the system controller 122. The toner 114 ideally remains on the surface of the ITB 103 after it passes through the nip for subsequent transfer (along with any other toner transferred by downstream devices 102) and ultimately fusing to the final print media 108 via the secondary transfer device 107 and fuser 110.

Figure 2:
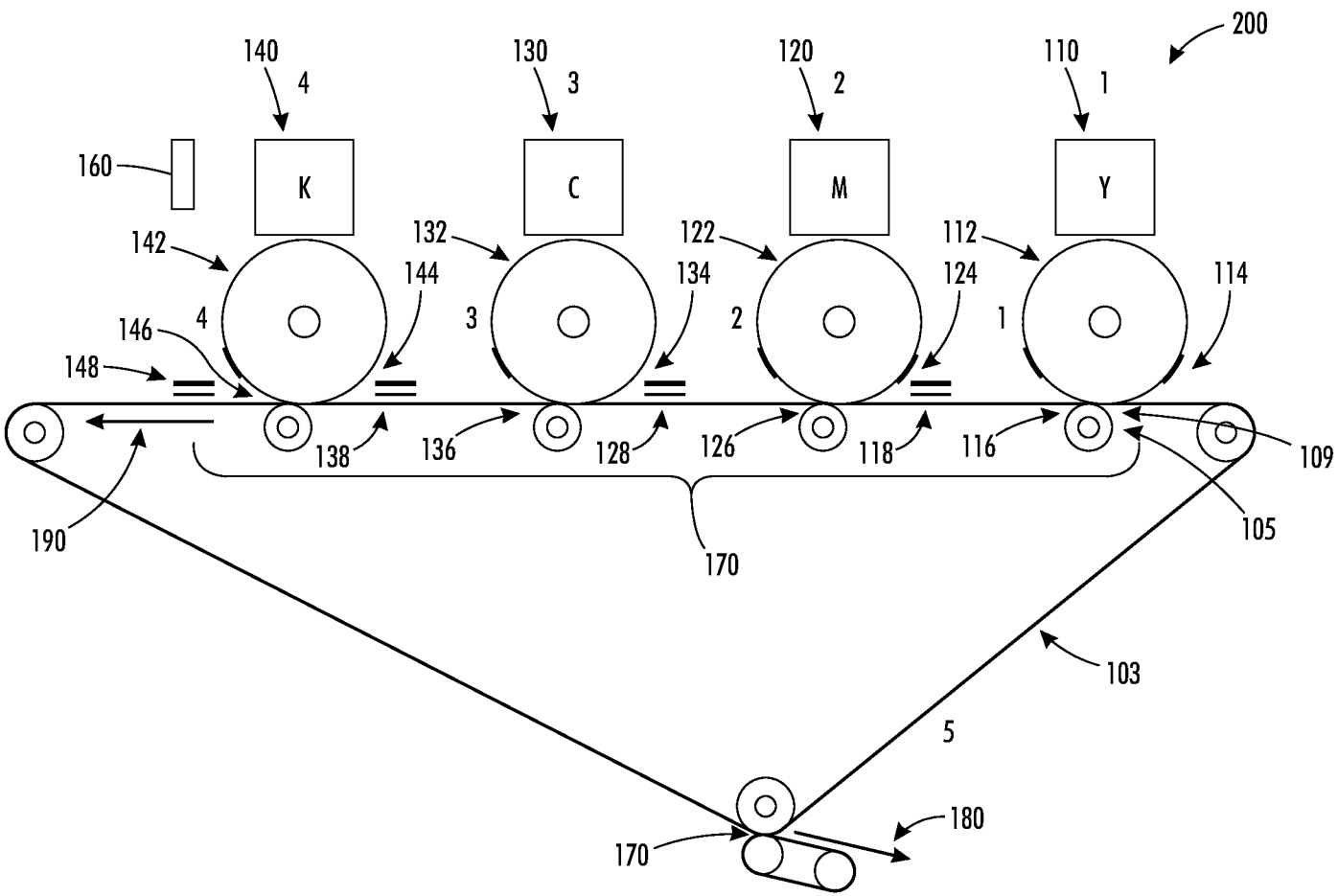
FIG. 2 is a simplified schematic of a document printing system showing the printhead, rollers, nips and detecting sensors in relation to a printing device.

As also shown in FIG. 2, the individual marking devices 102 may include one or more sensors 160 for sensing toner adhesion, toner mass per unit area, or other marking material transfer characteristic associated with the drum 104 and/or the intermediate transfer structure 103. The device-specific sensors 160 in FIG. 2 provide input signals or values to the controller 122, such as an optical (e.g. reflective) sensor 160 downstream of the BTR 105 for sensing the residual mass per unit area (RMA) of marking material (e.g., toner) 114 not transferred from the drum 104 to the belt 103, and an optional sensor 160 upstream of the BTR 105 for sensing the developed toner mass per unit area (DMA) or an optional sensor (e.g. an optical reflectance sensor) 160 downstream of the BTR 105 for sensing the transferred mass per unit area on the ITB 103. One or more sensors 160 may be provided for measuring a marking material transfer condition of the medium 114 separate from any of the marking devices 102, such as the sensor 160 shown in FIG. 2. Any type of sensor or sensors 160 may be employed which measure or sense toner state characteristics from which the toner transfer state of the marking device 102 can be derived. Suitable types of sensors 160 are described in DiRubio et al., U.S. Pat. No. 7,190,913, filed Mar. 31, 2005, owned by the assignee of the present disclosure, the entirety of which is incorporated by reference.

In normal operation, the marking devices 102 (e.g., FIG. 4) may suffer from incomplete transfer in which case a small amount of toner 114 remains on the drum 104 downstream of the BTR 105, particularly for low transfer field levels. The exemplary sensor 160 is operatively coupled with the controller 122 and located proximate the downstream side of the drum 104 to detect the amount of untransferred toner 114 remaining on the drum 104, where the illustrated example provides the sensor 160 as a residual mass per unit area (RMA) sensor that measures or senses the mass of residual toner 114 per a given area on the drum surface remaining after the drum 104 passes the nip at the BTR 105. The device 102 (or the system 200 generally) can optionally include additional sensors, such as a transferred mass/area (TMA) sensor for sensing the amount of toner 114 that is transferred to the intermediate medium 103, and a developed mass/area (DMA) sensor that detects the amount of toner 114 supplied on the drum 104 upstream of the nip at the BTR.

Figure 4:
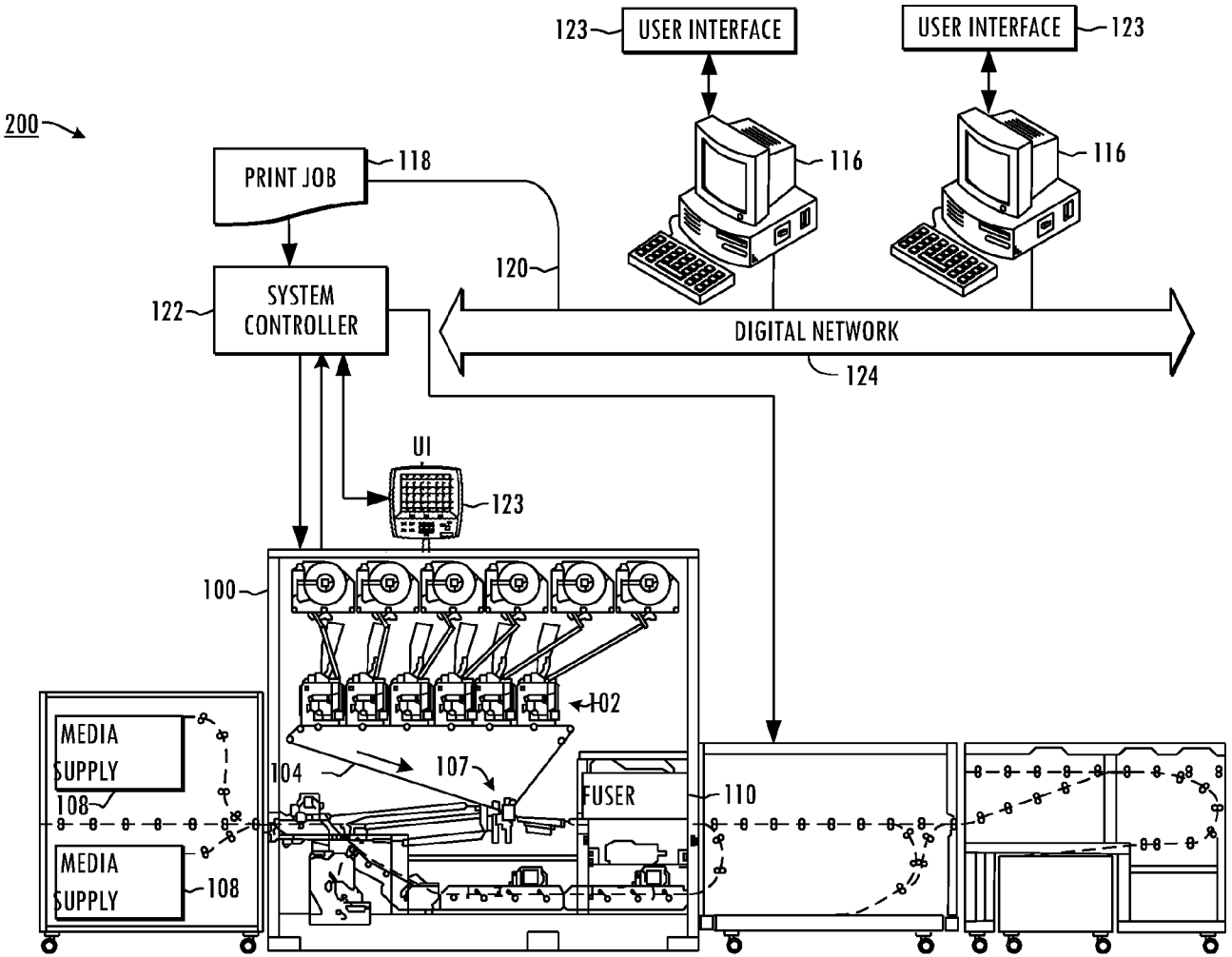
FIG. 4 is a detailed side elevation view illustrating an exemplary multi-color embodiment of the system of FIG. 2 in accordance with the present disclosure.

As illustrated in FIGS. 2 and 4, any integer number N marking devices 102 may be included in the system 200 of FIG. 1, where N is two or more. In one exemplary implementation, the system 200 may include six such marking devices 102, as in the example of FIG. 4, and typical systems 200 may include four devices 102, one each for yellow (Y, toner 114), magenta (M, toner 124), cyan (C, toner 134) and black (K, toner 144). The marking devices 102 individually include at least one first transfer field component (e.g., 106 in FIG. 5) controlling a first transfer field used to transfer marking material onto the intermediate transfer structure 103 with a transfer field control input receiving a first transfer field level signal or value 101 from the controller 122. Each of the xerographic marking devices 102 is operable under control of the controller 122 to transfer toner of a corresponding color to the intermediate transfer belt 103, where the first device 102 encountered by the ITB 103 in one example provides yellow toner 114, the next device provides magenta toner 124, the next provides cyan toner 134, and the last device 102 provides black toner 144, although other organizations and configurations are possible in which two or more marking devices 102 are provided.

The system 200 in FIG. 4 includes an embodiment of the document processing system 100 with six marking stations 102 along with a transfer station 106, a supply of final print media 108, and a fuser 110 as described in FIG. 2 above. In normal operation, print jobs 118 are received at the controller 122 via an internal source such as a scanner and/or from an external source, such as one or more computers 116 connected to the system 200 via one or more networks 124 and associated cabling 120, or from wireless sources. Moreover, user prompting and selections can be made using a user interface 123 associated with the system 200 and/or with the computers 116.

As shown in FIGS. 2 and 4, the system 200 also includes a secondary transfer component 106 (FIG. 2) disposed downstream of the marking devices 102 along a lower portion of the intermediate belt path to transfer marking material in a second transfer operation from the belt 103 to an upper side of a final print medium 108 (e.g., precut paper sheets in one embodiment) traveling along a path from a media supply (FIG. 4). After the transfer of toner to the print medium 108 at the transfer station 107, the final print medium 108 is provided to a fuser type affixing apparatus 110 on the path in which the transferred marking material is fused to the print medium 108. The system 200 may also include a scanner or other suitable image sensing apparatus downstream of the secondary transfer component 106 for sensing the image created by the first and second transfer operations, and providing corresponding image signals or values to the controller 122.

The controller 122 is operative to perform various control functions and may implement digital front end (DFE) functionality for the system 200, where the controller 122 may be any suitable form of hardware, processing component(s) with processor-executed software, processor-executed firmware, programmable logic, or combinations thereof, whether unitary or implemented in distributed fashion in a plurality of components, wherein all such implementations are contemplated as falling within the scope of the present disclosure and the appended claims. In a normal printing mode, the controller 122 receives incoming print jobs 118 and operates the marking devices 102 to transfer marking material onto the intermediate medium 103 in accordance with the print job 118, in particular, by providing first transfer field level signals or values 101 to control the transfer fields of the first transfer field components 105. The controller 122, moreover, operates the secondary transfer component 107, the fuser 110, and interfaces with the various sensors 160 and the network 124 in the illustrated embodiments.

With particular reference to FIG. 2, it can be seen that the transfer belt moves in a direction 190, with caving tension adjustment 180 initiated by a sensor 160. The developing color section 170 transfers color patches of yellow 110, magenta 120, cyan 130 and black 140 via preselected electrostatic fields imparted on the print drums 112, 122, 132, 142 respectively, for inks of yellow 114, magenta 124, cyan 134 and black 144. Nip 109 is disposed at the first junction at which the print drum 112 intersects the belt 103 and support roll 105. The nips are located where the yellow 116, magenta 126, cyan 136 and black 146 photoreceptors meet the intermediate transfer belt 103. The color transfer is completed when ink is supplied for yellow 118, magenta 128, cyan 138 and black 148. The lead patch 138 is made up of a yellow patch and a magenta patch in a two-step process which usually involves the subject retransfer.

More particularly, one retransfer step occurs at the cyan nip 136 and one occurs at the black nip 146. During retransfer air breakdown occurs within the first transfer nip thus transferring wrong sign toner. The wrong sign toner retransfers to the photoreceptor drums, away from the intended intermediate transfer belt. The retransfer defect is spatially non-uniform, which can cause the final print to look mottled and non-uniform. Because of the amount of retransfer nips that a particular image may go through during the printing process, a process often referred to as a retransfer history, this defect is especially noticeable in blended color patches such as red (Y+M) and green (Y+C). The density of the retransferred ink is measured by sensor 160 and may vary by the adjustment of distance between ink drums.

The printer develops and transfers several control patches. These patches are transferred at different electrostatic set points. The proposed control strategy utilizes one or more density sensors to measure the transferred toner patches and uses the density information to compute the optimal value of electrostatic transfer bias. The control strategy can allow the print operators to adjust the optimal value of electrostatic transfer bias based on their preferences, which provides a more robust first transfer system. The control strategy can be applied to more than four colors xerographic intermediate transfer belt 103 marking engines.

Figure 3:
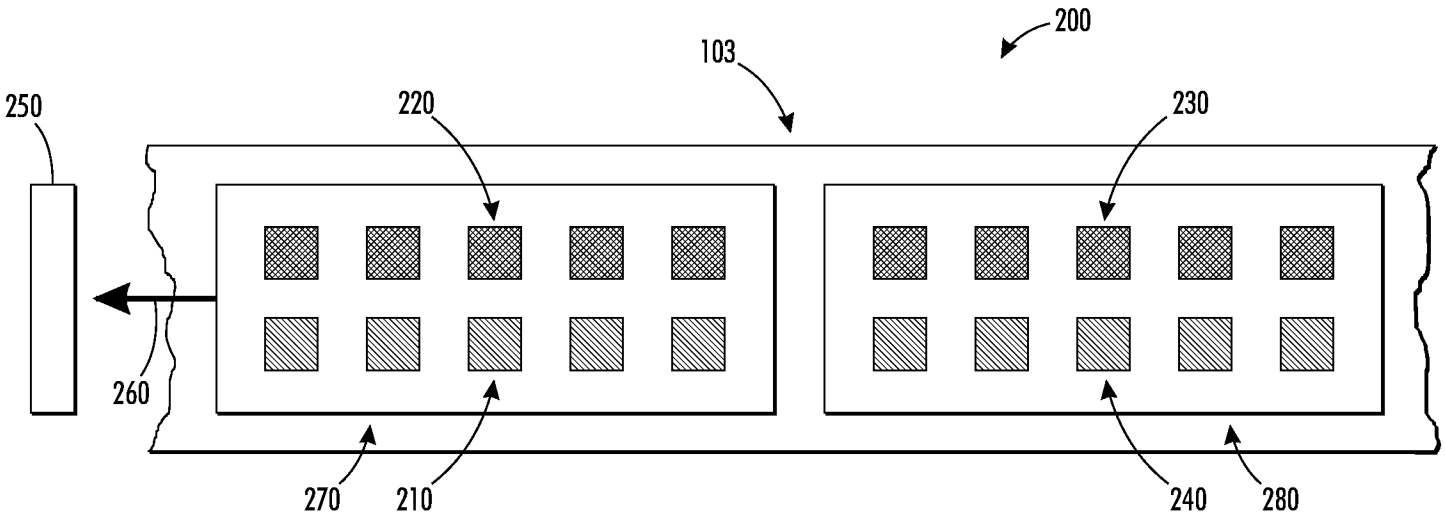
FIG. 3 shows a plurality of color transfer onto a shared intermediate transfer structure (ITB)

FIG. 3 presents the present applications, proposed principles of operation 200. The intermediate transfer belt 150 contains two sections 270, 280 containing color control and traveling in a forward 260 direction. During the setup process prior to a print job, the printer develops three or more yellow 210, magenta 220, red 230, and green 240 control patches. The color of control patches are designed depending on the marking engine architecture. The patches are transferred using bias set points. A bias set point is a voltage level at which a first transfer is set to occur, and is measured in either microamps or volts. The initial value is a nominal value and subsequent patches are set to variance point at three or more electrostatic transfer bias set points such as, but not limited to, nominal, ±10%, ±20%. The density sensors 250, located after the last first transfer nip, measure the density of these patches. The control algorithm then determines the highest density of each color patch from the sweep of transfer bias set points, and through transfer functions, computes the optimal first transfer bias. The control patches may or may not be transferred to a substrate at second transfer. If the decision is to skip second transfer they will be removed via the intermediate transfer belt (ITB) 103 cleaning process.

An optimal first transfer point is the best layer single and uses a function to allow a user to specify and enter a set of complex color weights in order to optimize performance. In the present case, the weighted colors would be cyan, magenta, yellow, and black. In alternative embodiments, the four colors could be different and there may be more than four colors or less than four colors. Responses from sensors are used to evaluate the final output color.

The following transfer function computes the optimal first transfer bias:

$$\text{Optimal First Transfer Bias}=(0.5*(R+G)-0.5*(M+Y))*X+0.5*(M+Y)$$

Where R=transfer bias when red patch's density is the highest

G=transfer bias when green patch's density is the highest

M=transfer bias when magenta patch's density is the highest

Y=transfer bias when yellow patch's density is the highest and X=weight from 0 to 1, where 0: single separation is more desired and 1: blended color is more desired, X can be operator adjustable based on his/her preference. By default, X is set to 0.5.

When the optimal first transfer bias is applied, the operator can opt to print a sample for viewing and making any changes. If the operator is satisfied with the print quality, the operator then accepts the settings and runs his print job. If he does not accept the settings, then he can adjust the X level via a graphical user interface on the printer. The printer then readjusts according to the input value and re-prints the print sample for the operator to approve. In other configurations, the printer can automatically print the job without seeking the operator's input. This process may be repeated iteratively until the operator is satisfied with the settings and print quality, or the operator ceases to enter data or make choices, or indicates otherwise.

For example, during setup, the blended colors transferred optimally at 30 uA and single colors transferred optimally at 20 uA. The printer computes 25 uA as the optimal first transfer bias. The operator then selects to view the print sample. If the operator wishes to print a monochrome job, he can adjust the weight value of X to zero. The printer then readjusts the optimal first transfer bias to 20 uA and makes a print sample. If the operator accepts the new print, the operator starts his print job. If not, he repeats the process until he is satisfied with the print sample.

The proposed embodiments are significantly advantageous over current xerographic intermediate transfer belt 103 transfer control strategy because they take into account image content, which ultimately is important to end-users and customers. In addition, the proposed method is fairly easy and affordable to integrate since it utilizes hardware that exists in today's printing systems.

FIG. 5 presents a detailed view of the nip 109 at which the print head 104 impacts the print media 151, which is supported by a roller 105 on the opposite side of the print media under the nip 109. A sensor 160 measures the density of the ink placed on the print media 151 and transmits the data to a system controller 122. This information is used to transmit signals 101 to a grounded controller unit 161.

FIG. 1 presents an embodiment comprising the method 10 of inserting transfer bias values and measuring the results with a sensor 160 in order to employ the method in a manner that reduces transfer bias. First, three transfer biases are selected 11 and the transfer biases set points are selected 20. Then the transfer biases and set points are used to print test patches 30. A sensor 160 then measures the density of the test patches 40. From this, a control algorithm determines the highest density of each color patch 50 and the data is used as an optimal first transfer bias is computed 60. Highest density can generally be associated with lowest retransfer problems. After the settings have been set up, a sample is printed and evaluated 70. If the operator evaluates 80 (such as through a user interface 123) and is satisfied 97 with the sample printing, then the settings are saved and used to print a print job. However, if the setting evaluated to be not satisfactory 93, then the process is repeated 95 starting with selecting transfer bias points 20. This method may employ a computer processor to perform the calculations necessary to incorporate input user data, to perform calculations on that or any other data, and to interpret and perform calculations on any of the sensor data.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method of operating a document processing system having a plurality of marking devices of different colors individually operable to transfer marking material in a first transfer operation onto an intermediate transfer structure, the method comprising:

a) importing a plurality of control patches of preselected colors wherein the colors are repetitively imported in control patches at a plurality of electrostatic transfer bias set points;

b) sensing a density of the control patches with a sensor;

c) detecting a highest density color of the repetitively imported patches; and d) determining an optimal first transfer bias based on the detected highest density, whereby subsequent operation of the document printing system selectively employs the optimal first transfer bias;

wherein the determining comprises computing the optimal first transfer bias (OFTB) by a function:

$$\text{Optimal First Transfer Bias}=(0.5*(R+G)-0.5*(M+Y))*X+0.5*(M+Y)$$

where R=transfer bias when red patch's density is the highest

G=transfer bias when green patch's density is the highest

M=transfer bias when magenta patch's density is the hiqhest

Y=transfer bias when yellow patch's density is the highest and X=weight from 0 to 1, where 0 means single separation is more desired and 1 means blended color is more desired.

2. The method of claim 1 wherein the weighting X is operator adjustable.

3. The method of claim 2 wherein the weighting X is variable between 0 and 1, and the importing includes further importing a second plurality of control patches with an operator adjusted X weighting.

4. The method of claim 1 where the value of weighting X may be adjusted through operator use of a graphical user interface.

5. The method of claim 1 wherein the sensing is effected on the intermediate transfer structure.

6. The method of claim 1 wherein the importing includes retransferring the test patches from the intermediate transfer structure to a substrate at a second transfer, and the sensing is effected on the substrate.

7. The method of claim 1 wherein the sensing comprises sensing the control patches with an extended toner area coverage sensor selectively disposed for sensing the control patches at either the intermediate transfer structure or at a substrate receiving a transfer of the control patches from the intermediate transfer structure.

8. The method of claim 1 wherein the plurality of electrostatic transfer bias set points are at one of nominal, +/−10%, or +/−20%.

9. A method of controlling print transfer using transfer biases and bias set points comprising the steps of:

a) selecting first color transfer biases;

b) selecting first color transfer biases set points;

c) printing test patches using transfer biases and set points varied from the first color transfer biases and the first color transfer biases set points;

d) determining a highest density color patch from the test patches;

e) computing an optimal first transfer bias;

f) printing and evaluating a sample patch;

g) repeating the process beginning with step b) selecting other transfer bias set points, until an operator signals an approval; and h) employing the approved settings to print a job;

where the optimal first transfer bias is calculated using an algorithm which comprises:

$$\text{Optimal First Transfer Bias}=(0.5*(R+G)-0.5*(M+Y))*X+0.5*(M+Y)$$

where R=transfer bias when red patch's density is the highest

G=transfer bias when green patch's density is the highest

M=transfer bias when magenta patch's density is the highest

Y=transfer bias when yellow patch's density is the highest and X=weight from 0 to 1, where 0 means single separation is more desired and 1 means blended color is more desired.

10. The method of claim 9 where the value of X may be adjusted by a user interface.

11. The method of claim 9 where the value of X is limited to between 0 and 1.

12. A system for controlling print transfer comprising:

a printer comprised of a plurality of one color print modules, each module comprising a print head and an adjoining nip, each module associated with one individual color;

at least one sensor associated with each individual color;

a processor to process an algorithm to calculate the optimal transfer bias based on data gathered by the sensors;

a graphical user interface to facilitate user data entry and approval acknowledgment data;

and wherein the processor further receives the data gathered by the sensor, receives user entered settings data and executes the algorithm using the received data;

and the printer prints at least one test patch printed out in response to a calculated optimal transfer bias;

where the algorithm comprises:

$$\text{Optimal First Transfer Bias}=(0.5*(R+G)-0.5*(M+Y))*X+0.5*(M+Y)$$

where R=transfer bias when red patch's density is the highest

G=transfer bias when green patch's density is the highest

M=transfer bias when magenta patch's density is the highest

Y=transfer bias when yellow patch's density is the highest and X=weight from 0 to 1, where 0 means single separation is more desired and 1 means blended color is more desired.

13. The system of claim 12, wherein the graphical user interface receives adjustments to settings to facilitate user data entry and to receive user approval acknowledgments.

14. The system of claim 12, further comprising a memory for storage of sensor data, bias data and calculated values in a database format.

15. The system of claim 12 wherein the test patches are transferred to a substrate at a second transfer and then the optimal transfer bias is used to print a print job.

* * * * *